US005678746A

United States Patent [19]

Grendol

[11] Patent Number: 5,678,746

[45] Date of Patent: Oct. 21, 1997

[54] APPARATUS FOR USE IN TYING TOGETHER A PAIR OF SHOELACE EYELETS WITH A PLASTIC FASTENER

[75] Inventor: Clark L. Grendol, Sturbridge, Mass.

[73] Assignee: Avery Dennison Corporation, Pasadena, Calif.

[21] Appl. No.: 569,744

[22] Filed: Dec. 8, 1995

[51] Int. Cl.[6] ..... B25C 1/00

[52] U.S. Cl. ..... 227/67; 227/71; 227/140; 12/142 LC; 12/113; 24/711.1

[58] Field of Search ..... 227/67, 71, 18, 227/124, 140, 151; 12/142 LC, 113; 24/711.1; 206/820

[56] References Cited

U.S. PATENT DOCUMENTS

| | | | |
|---|---|---|---|
| 4,296,515 | 10/1981 | Hauser | 12/142 LC |
| 4,589,583 | 5/1986 | Kunreuther et al. | 227/67 |
| 4,664,306 | 5/1987 | Levy | 227/67 |
| 5,438,724 | 8/1995 | Merser | 12/142 LC |
| 5,472,130 | 12/1995 | Beringhause et al. | 227/67 |

*Primary Examiner*—Scott A. Smith

*Attorney, Agent, or Firm*—Kriegsman & Kriegsman

[57] ABSTRACT

An apparatus for use in tying together a pair of opposing shoelace eyelets of a shoe upper with a plastic fastener of the type comprising a flexible filament having a cross-bar disposed at one end thereof and a paddle comprising an opening disposed at the opposite end thereof. The apparatus includes a hollow slotted needle insertable through the pair of opposing shoelace eyelets and the opening in the paddle, a paddle positioning assembly for aligning the opening in the paddle with the pair of opposing shoelace eyelets, a cross-bar feeding assembly for loading the cross-bar into the needle, and a cross-bar ejecting assembly for ejecting the cross-bar from the needle. Where the plastic fastener is formed as part of a web of continuously connected fastener stock, the apparatus preferably further includes a web advancement assembly for advancing the web so that the paddle and the cross-bar of a plastic fastener are brought into register with the paddle positioning assembly and the cross-bar ejecting assembly, respectively.

13 Claims, 8 Drawing Sheets

APPARATUS FOR USE IN TYING TOGETHER A PAIR OF SHOELACE EYELETS WITH A PLASTIC FASTENER

BACKGROUND OF THE INVENTION

The present invention relates generally to plastic fasteners and fastener attaching tools and more particularly to plastic fasteners and fastener attaching tools designed for use in tying together pairs of shoelace eyelets in such a way as to maintain an appropriate spacing therebetween, for example, during shoe-lasting.

Shoe-lasting is a technique commonly employed in the manufacture of footwear for working a shoe upper into its proper form prior to the attachment of a sole thereto. Typically, shoe-lasting comprises placing an unworked shoe upper over a shoe-last, i.e., a mandrel having a shape similar to a shoe tree, and then heating and pulling the shoe upper around the shoe last until the upper conforms generally to the shape of the shoe last.

For shoes of the type that are provided with shoelace eyelets, the above-described technique can pose a problem because the tensioning of the shoe upper around the shoe last can cause the spacing between opposing eyelets on the upper to deviate from what it should be. One approach that has been used to maintain the proper spacing between opposing eyelets on the upper has been to tie together the eyelets with string or the like. Typically, this tying operation is performed manually or with a specifically-designed machine. However, machines of this type have not been made for several years and are, therefore, quite old. In addition, such machines are rather difficult and costly to maintain and use.

Another approach that has been used to maintain the proper spacing between opposing eyelets of a shoe upper during shoe-lasting has been to couple together pairs of opposing eyelets on the upper using plastic fasteners of the type comprising an elongated filament terminating at each end in a cross-bar. To attach the fastener to a shoe upper, one of the cross-bars is inserted through a pair of opposing eyelets on the shoe upper, the other cross-bar not being inserted through either of the eyelets. The cross-bars are appropriately sized so that the fastener cannot easily be pulled through either of the eyelets. This approach, however, has not been found to be entirely satisfactory. This is because, where the eyelets of the upper are relatively large compared to the size of the cross-bars, the magnitude of the force used to pull the upper over the shoe-last is often so great as to cause at least one of the cross-bars to be bent inwardly and then pulled through its respective eyelet.

In commonly-assigned U.S. Pat. No. 5,438,724, inventor Merser, which issued Aug. 8, 1995, and in commonly-assigned U.S. patent application Ser. No. 08/424,910, inventor Merser, which was filed Apr. 19, 1995, both of which are incorporated herein by reference, there is disclosed a plastic fastener which is designed for use in tying together a pair of opposing shoelace eyelets for shoe-lasting applications and which solves many of the problems discussed above. According to one embodiment, the fastener is a unitary plastic member shaped to include an elongated flexible filament having a cross-bar at one end and a paddle at the opposite end, the paddle being provided with two or more alternative openings through which the cross-bar may be inserted to form a loop. The openings are preferably disposed at different points along the length of the paddle so that different sized loops may be used for different eyelet spacings. To tie together a pair of opposing shoelace eyelets with the above-described fastener, the paddle of the fastener is positioned so that one of its openings is aligned with the eyelets to be tied together. The filament is then drawn over the upper to the opposite eyelet, and the cross-bar is inserted first through the pair of eyelets and then through the desired opening in the paddle.

As can readily be appreciated, because the paddle and the cross-bar of the aforementioned plastic fastener are mechanically coupled to one other via the flexible filament of the fastener, one problem that has been encountered in using the fastener to tie together opposing shoelace eyelets is that it can be difficult to maintain the alignment of the opening in the paddle behind one of the shoelace eyelets as the cross-bar is being drawn over the upper to the opposite eyelet and then inserted through the eyelets and the paddle. This is particularly so if the paddle is being held in place manually, and a conventional hand-held fastener attaching tool is being used to insert the cross-bar through the eyelets and the opening in the paddle. Moreover, automated machinery for use in tying together opposing shoelace eyelets with fasteners of the type described above has not previously been in existence.

Other patents that may be of interest include U.S. Pat. No. 5,465,442, inventor Merser, which issued Nov. 14, 1995; U.S. Pat. No. 760,385, inventors Donovan et al., which issued May 17, 1904; U.S. Pat. No. 1,161,871, inventor Lewis, which issued Nov. 30, 1915; U.S. Pat. No. 3,131,490, inventor Rowen, which issued May 5, 1964; U.S. Pat. No. 1,274,700, inventor Fernald, which issued Aug. 6, 1918; U.S. Pat. No. 4,094,029, inventor Carlile, which issued Jun. 13, 1978; U.S. Pat. No. 4,296,515, inventor Hauser, which issued Oct. 27, 1981; U.S. Pat. No. 827,987, inventor Miles, which issued Aug. 7, 1906; U.S. Pat. No. 223,598, inventor McGeorge, which issued Jan. 13, 1880; U.S. Pat. No. 234,488, inventor McKay, which issued Nov. 16, 1880; U.S. Pat. No. 3,273,705, inventors Rieger et al., which issued Sep. 20, 1966; U.S. Pat. No. 2,010,583, inventor Canter, which issued Aug. 6, 1935; U.S. Pat. No. 2,326,693, inventor Sindler, which issued Aug. 10, 1943; U.S. Pat. No. 3,977,050, inventor Perez, which issued Aug. 31, 1976; U.S. Pat. No. 651,128, inventor Arnemann, which issued Jun. 5, 1900; U.S. Pat. No. 416,771, inventor Wilson, which issued Dec. 10, 1889; U.S. Pat. No. 3,315,324, inventor Ward, which issued Apr. 25, 1967; U.S. Pat. No. 4,955,475, inventors McCarthy et al., which issued Sep. 11, 1990; and Germany No. 1079537, published Apr. 7, 1960, all of which are incorporated herein by reference.

SUMMARY OF THE INVENTION

It is an object of the present invention to provide a novel apparatus for use in tying together opposing shoelace eyelets of a shoe upper for maintaining a desired spacing therebetween, for example, during shoe-lasting.

It is another object of the present invention to provide a novel apparatus for use in tying together opposing shoelace eyelets of a shoe upper with a plastic fastener for maintaining a desired spacing therebetween, for example, during shoe-lasting.

It is still another object of the present invention to provide an apparatus for use in tying together opposing shoelace eyelets of a shoe upper with a plastic fastener of the type comprising a flexible filament having a cross-bar disposed at one end thereof and a paddle provided with at least opening disposed at the opposite end thereof for maintaining a desired spacing between said opposing shoelace eyelets, for example, during shoe-lasting.

In furtherance of the above objects as well as additional objects to become apparent below, there is hereinafter provided in accordance with the teachings of the present invention an apparatus for use in tying together a pair of opposing shoelace eyelets of a shoe upper with a plastic fastener of the type comprising a flexible filament having a cross-bar disposed at one end thereof and a paddle comprising an opening disposed at the opposite end thereof, said apparatus comprising (a) means for positioning the paddle of the plastic fastener so that the opening is aligned with the pair of opposing shoelace eyelets; and (b) means for inserting the cross-bar of the plastic fastener first through the pair of opposing eyelets and then through the opening in the paddle.

Additional objects, as well as features, advantages and aspects of the present invention, will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
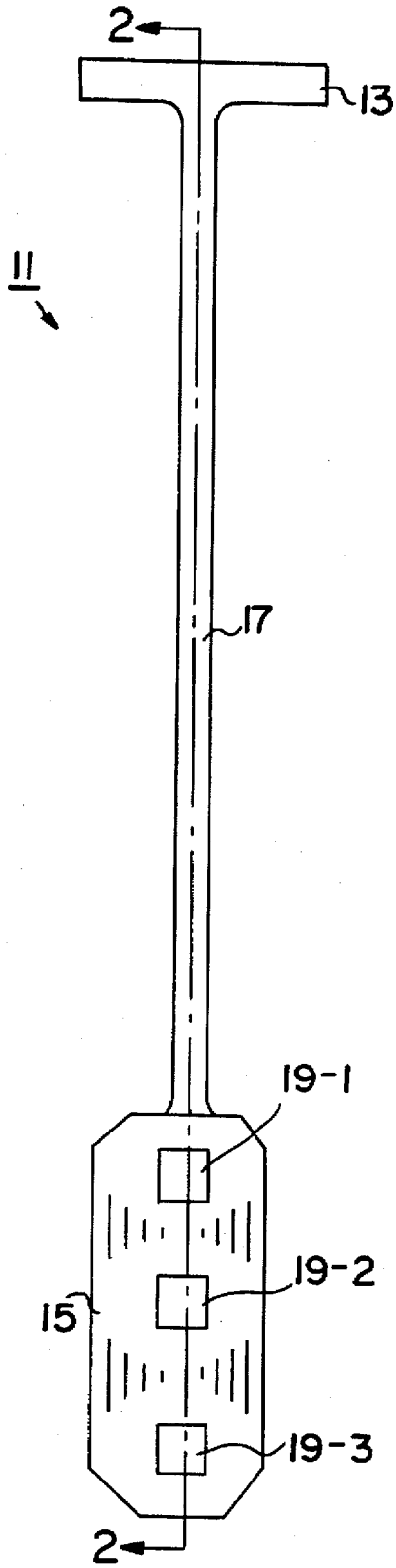
FIG. 1 is a front view of one type of plastic fastener well-suited for tying together opposing shoelace eyelets on a shoe upper in such a way as to maintain the proper spacing therebetween, for example, while the shoe upper is being lasted.
Figure 2:
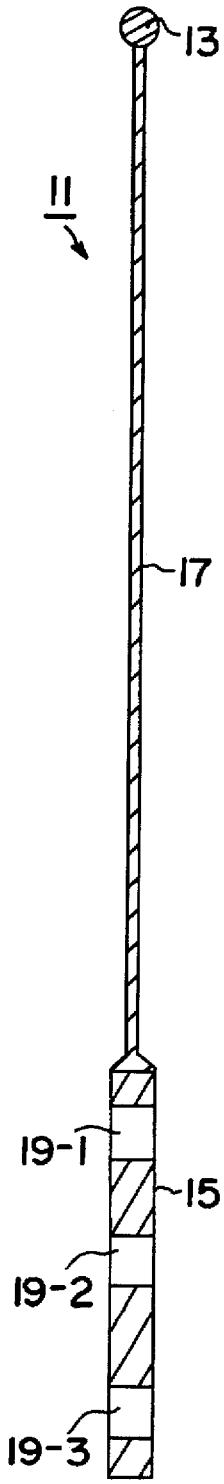
FIG. 2 is a section view of the plastic fastener shown in FIG. 1 taken along line 2—2.

Referring now to FIGS. 1 and 2, there are shown front and section views of one type of plastic fastener that is well-suited for tying together a pair of opposing shoelace eyelets on a shoe upper in such a way as to maintain the proper spacing therebetween, for example, while the shoe upper is being lasted, the plastic fastener being represented generally by reference numeral 11.

Fastener 11, which is described in detail in U.S. Pat. No. 5,438,724 already incorporated herein by reference, is a unitary plastic member shaped to include a cross-bar 13 at one end, a paddle 15 at the opposite end, and an elongated flexible filament 17 interconnecting cross-bar 13 and paddle 15.

A plurality of openings 19-1 through 19-3 are spaced along the length of paddle 15. As will be discussed below in greater detail, each of openings 19-1 through 19-3 is appropriately sized and shaped so that the ends of fastener 11 may be secured together by inserting cross-bar 13 through one of openings 19-1 through 19-3 to form a loop. As can readily be appreciated, because openings 19-1 through 19-3 are disposed at different points along the length of paddle 15, eyelets of different spacings can be tied together using fastener 11 merely by inserting cross-bar 13 through different openings 19-1 through 19-3. In the present embodiment, fastener 11 is appropriately dimensioned for use in tying together eyelets that are spaced apart 18 mm, 20 mm or 22 mm (i.e., by inserting cross-bar 13 through opening 19-1, opening 19-2 or opening 19-3, respectively).

Figure 3:
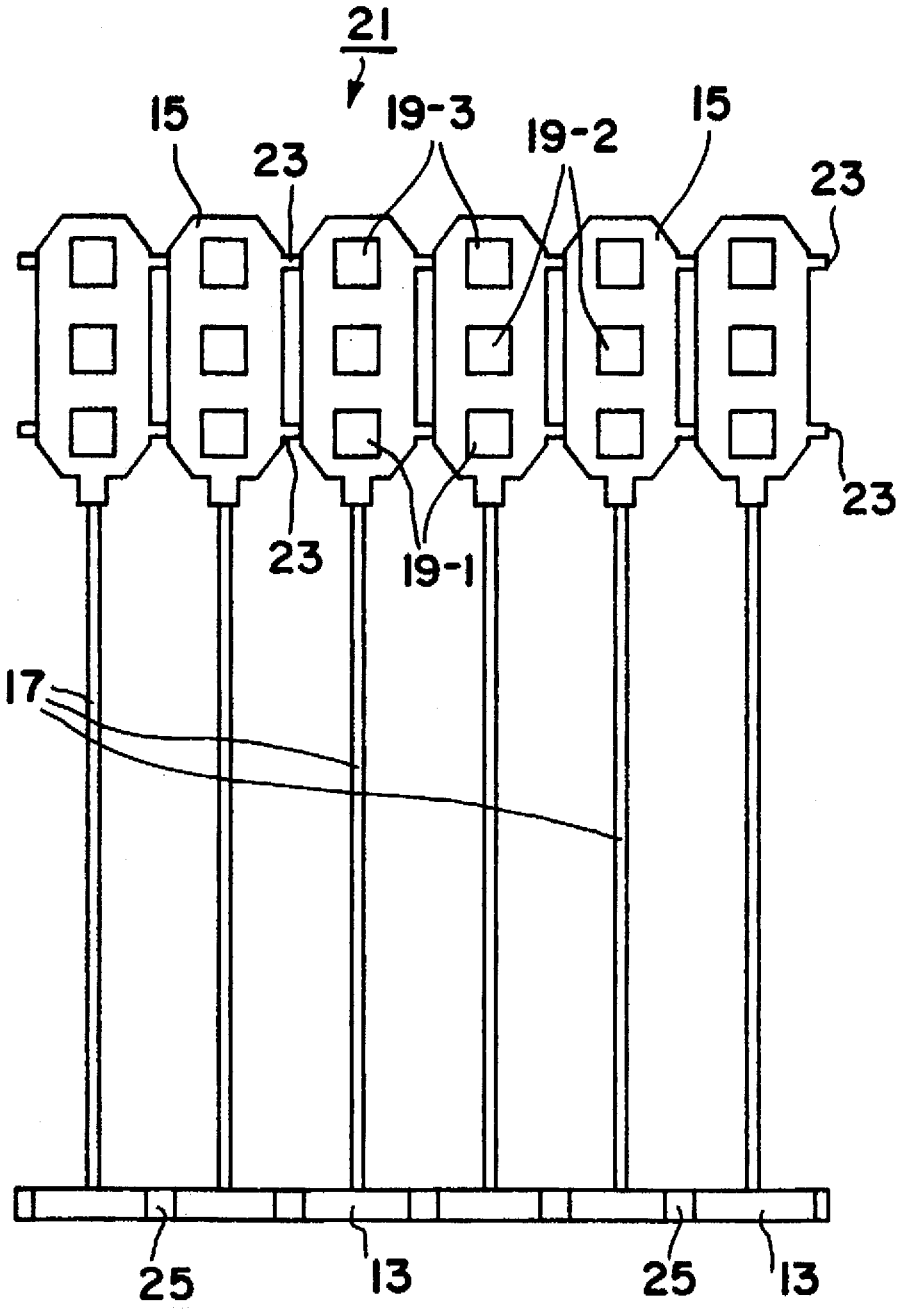
FIG. 3 is a front view of a plurality of plastic fasteners of the type shown in FIG. 1 which have been fabricated as part of a web of continuously connected fastener stock.

Fastener 11 is preferably molded as part of a web of continuously connected fastener stock of the general type described in U.S. Pat. No. 4,955,475. Referring now to FIG. 3, there is shown a web 21 of fasteners 11, adjacent fasteners 11 being attached at their respective paddles 15 by severable connectors 23 and at their respective cross-bars 13 by severable connectors 25.

Figure 4:
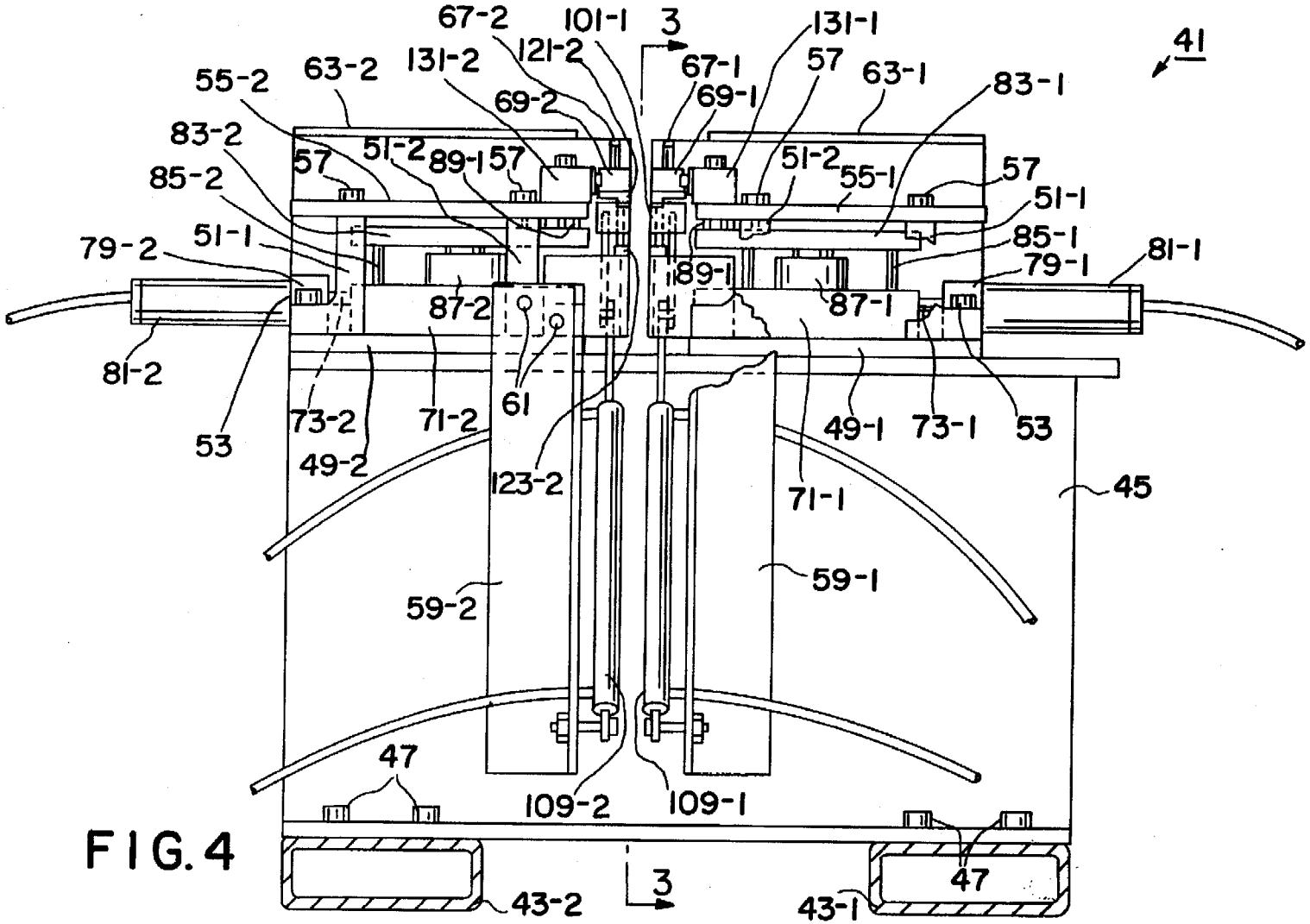
FIG. 4 is a rear view of one embodiment of an apparatus constructed according to the teachings of the present invention for use in tying together two pairs of opposing shoelace eyelets of a shoe upper so as to maintain the proper spacing between the opposing eyelets, for example, during shoe-lasting using plastic fasteners of the type formed as part of a web as shown in FIG. 3.
Figure 5:
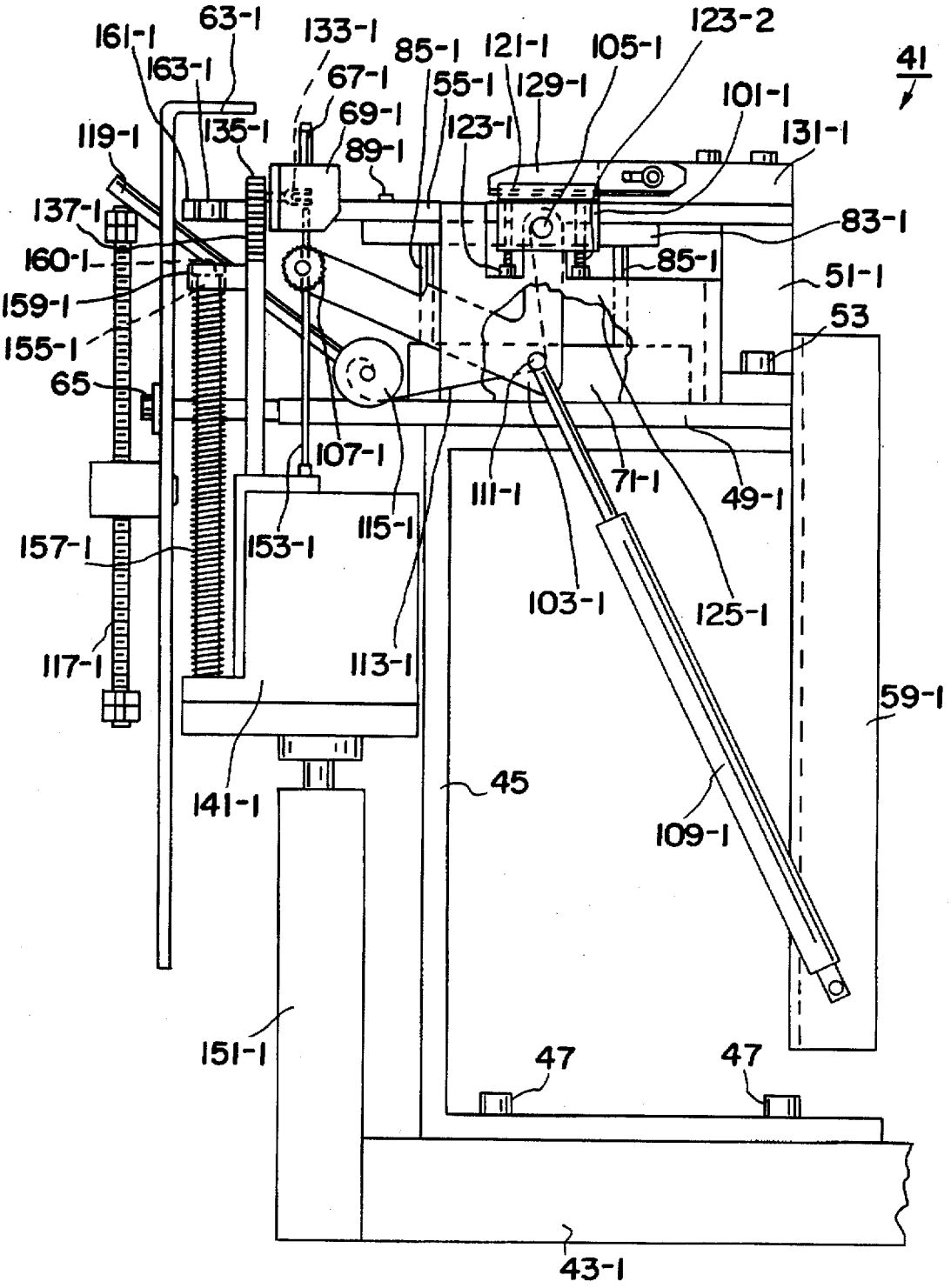
FIG. 5 is a section view of the apparatus shown in FIG. 4 taken along line 3—3.
Figure 6:
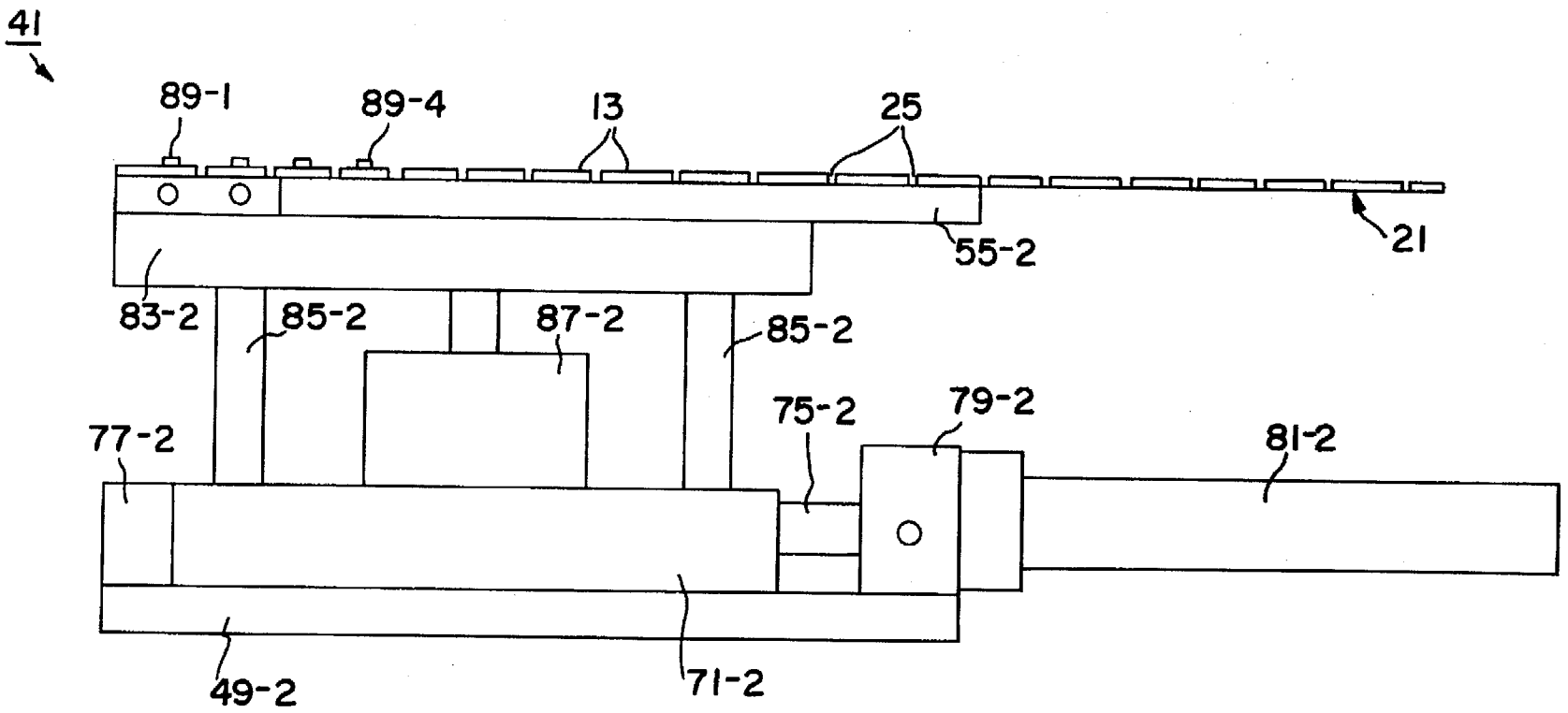
FIG. 6 is a simplified enlarged front view of the right portion of the apparatus shown in FIG. 4 illustrating the web advancing means, certain parts of the apparatus not being shown for clarity.

Referring now to FIGS. 4 and 5, there are shown rear and section views, respectively, of one embodiment of an apparatus constructed according to the teachings of the present invention for use in tying together two pairs of opposing shoelace eyelets of a shoe upper so as to maintain the proper spacing between the opposing eyelets, for example, during shoe-lasting using plastic fasteners of the type formed as part of a web as shown in FIG. 3, the apparatus being represented generally by reference numeral 41. For simplicity and clarity, parts not directly pertinent to the invention are not shown or are shown only diagrammatically in the present drawings and/or are not described in detail below. Moreover, as can be seen in FIG. 4, apparatus 41 is generally symmetrical about line 3—3, i.e, the left and right portions of apparatus 41 are mirror-images of one another. Accordingly, it may be assumed, unless otherwise indicated or apparent, that parts shown and/or described in reference to the left portion of apparatus 41 exist in a mirror-image relation in the right portion of apparatus 41 and vice versa.

Apparatus 41 comprises a frame, the frame including a pair of feet 43-1 and 43-2. An upwardly-extending C-shaped supporting bracket 45 is mounted on top of feet 43-1 and 43-2 via bolts 47. A pair of platforms 49-1 and 49-2 are spaced apart on top of bracket 45. A plurality of upwardly-extending L-shaped brackets 51-1, 51-2 and 51-3 (bracket 51-3 not shown) are positioned on top of each platform 49. Bolts 53 are used to secure brackets 51 to their respective platform 49 and to underlying bracket 45. A pair of web carrying plates 55-1 and 55-2 are mounted on top of brackets 51 via bolts 57. In this manner, plates 55-1 and 55-2 are spaced upwardly from platforms 49-1 and 49-2, respectively. A pair of L-shaped rear brackets 59-1 and 59-2 are secured to the rear faces of L-shaped brackets 51-2, respectively, via bolts 61. A pair of L-shaped front brackets 63-1 and 63-2 are fixedly coupled to platforms 49-1 and 49-2, respectively, via bolts 65.

Apparatus 41 also comprises a pair of hollow, slotted needles 67-1 and 67-2. Each needle 67 is appropriately sized and shaped to be insertable first through a pair of opposing shoelace eyelets of a shoe upper and then through a desired opening 19 in a fastener 11. Each needle 67 is securely mounted within a needle block 69 which, in turn, is securely coupled to the frame of apparatus 41 by means not shown. Preferably, needles 67-1 and 67-2 are spaced apart or are capable of being adjustably spaced apart by a distance corresponding to the distance separating two pairs of opposing shoelace eyelets on a shoe upper. In this manner, two pairs of opposing shoelace eyelets can be tied together at the same time using apparatus 41.

Associated with each needle 67, apparatus 41 further includes means for feeding an individual cross-bar 13 of a web 21 into needle 67, means for positioning an individual paddle 15 of web 21 so that a desired opening 19 is aligned with needle 67, means for ejecting a cross-bar 13 that has been loaded into said needle from said needle through a pair of opposing eyelets of a shoe upper and then through the desired opening 19 in paddle 15 and means for advancing web 21 so that the leading cross-bar 13 of web 21 is brought into register with said cross-bar feeding means and so that the leading paddle 15 of web 21 is brought into register with said paddle positioning means.

Referring now to FIGS. 4 through 7, said web advancing means can be seen to comprise a first movable member 71, member 71 being seated on top of platform 49 and being slidably mounted side-to-side on a pair of parallel posts 73 and 75 between a pair of stops 77 and 79 by means of an air cylinder 81. Said web advancing means also comprises a second movable member 83, member 83 being slidably mounted up and down on a plurality of posts 85 between first movable member 71 and web carrying plate 55 by means of a pancake-shaped air cylinder 87. Twelve pins 89-1 through 89-12 are fixedly mounted on the top of second movable member 83 and extend upwardly therefrom in three rows of four.

Figure 7:
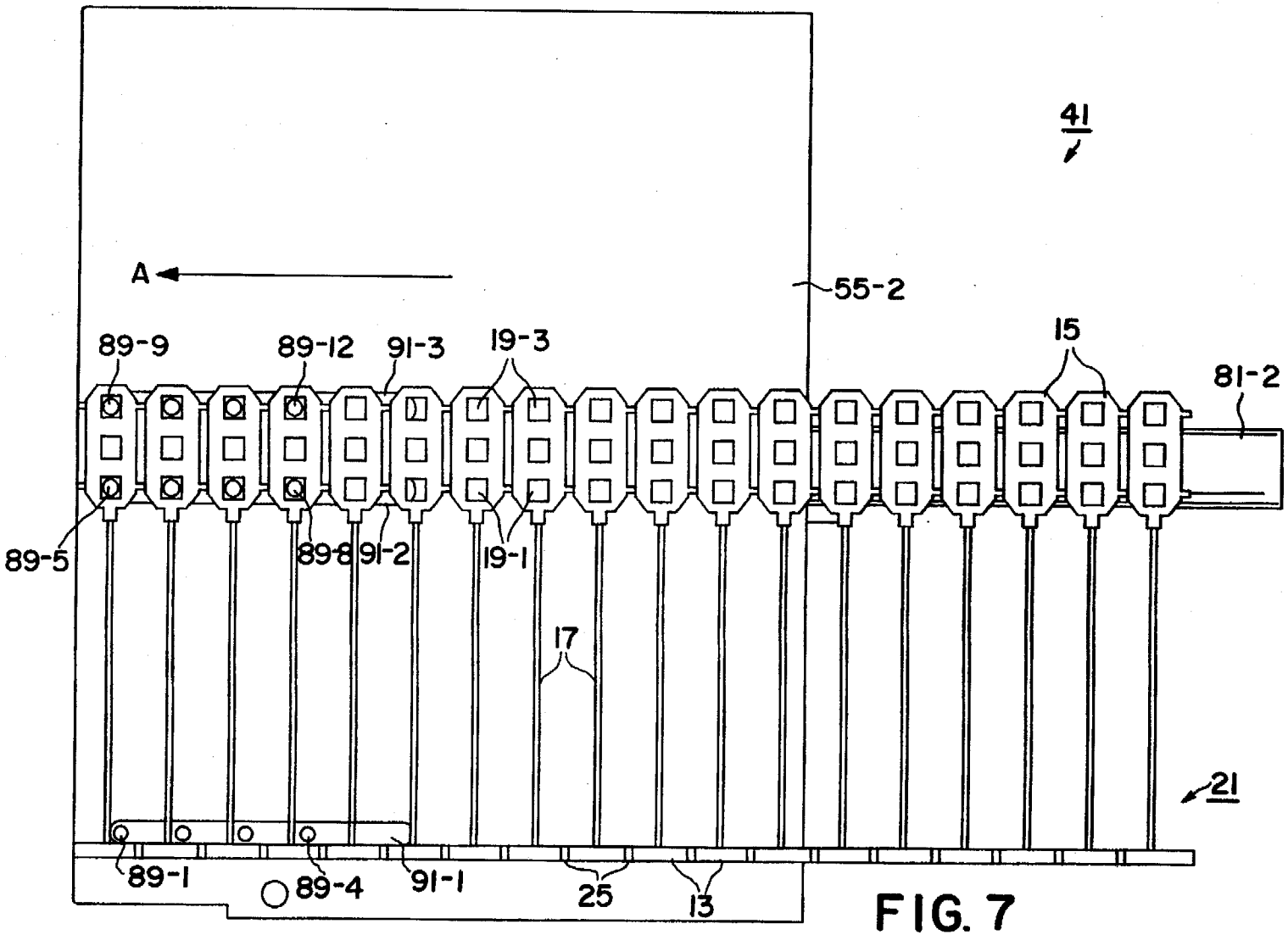
FIG. 7 is a simplified enlarged top view of the right portion of the apparatus shown in FIG. 4 illustrating the web advancing means, certain parts of the apparatus not being shown for clarity.

As seen best in FIG. 7, web carrying plate 55 is provided with three transverse slots 91-1 through 91-3, pins 89-1 through 89-4 being aligned with and inserted through slot 91-1, pins 89-5 through 89-8 being aligned with and inserted through slot 91-2 and pins 89-9 through 89-12 being aligned with and inserted through slot 91-3. Again, as seen best in FIG. 7, pins 89-1 through 89-12 are positioned relative to one another and are appropriately dimensioned so that, when movable member 83 is in its uppermost position, (1) pins 89-5 through 89-8 extend through the respective openings 19-1 of four adjacent fasteners 11 of web 21; (2) pins 89-9 through 89-12 extend through the respective openings 19-3 of four adjacent fasteners 11 of web 21; and (3) pins 89-1 through 89-4 are positioned behind the respective intersections of cross bar 13 and filament 17 of four adjacent fasteners 11 of web 21. When, due to the action of air cylinder 87, movable member 83 is in its lowermost position, pins 89-1 through 89-12 are brought out of engagement with fasteners 11 of web 21. Accordingly, advancement of web 21 by one fastener 11 in the direction indicated by arrow A of FIG. 7 is achieved by the following sequence of steps: (1) member 83 is lowered by air cylinder 87, thereby causing pins 89-1 through 89-12 to come out of engagement with the first- through fourth-leading fasteners 11 of web 21; (2) member 71 is moved towards stop 79-2 by air cylinder 81; (3) member 83 is raised by air cylinder 87, causing pins 89-1 through 89-12 to come into engagement with the second- through fifth-leading fasteners 11 of web 21; and (4) member 71 is moved towards stop 77 by air cylinder 81, causing the entire web 21 to move relative to web carrying plate 55 by one fastener 11 and causing fastener 11 to be moved off carrying plate 55 altogether. (A cover plate, not shown, may be used to keep web 21 flat against plate 55 so as to maintain engagement with pins 89.)

Referring now to FIGS. 4, 5, 8 and 9, said paddle positioning means can be seen to include a generally rectangular, hollow, paddle support 101. Paddle support 101, which is appropriately dimensioned to receive thereon a paddle 15 which has been advanced thereto from web carrying plate 55, is rotatably mounted on one end of an arm 103 via an axle 105. The opposite end of arm 103 is pivotally attached to the frame of apparatus 41 by means not shown at a pivot point 107. Pivotal movement of pivot arm 103 about pivot point 107 is provided by an air cylinder 109 (see FIGS. 4 and 5), which is mounted at one end on bracket 59-1 and at the opposite end on arm 103 at a point 111. Pivot arm 103 moves paddle support 101 back and forth between a first position in which pivot support 101 is flush with plate 55 and aligned with pins 89-5 through 89-12 and a second position in which pivot support is positioned over needle 67.

As seen best in FIG. 5, said paddle positioning means also includes a length of wire 113, wire 113 being drawn around point 111 and being fixed at one end to axle 105 and at the opposite end to a first end crankshaft 115. The length of wire 113 is such that, during the pivoting action of pivot arm 103, wire 113 causes the rotation of axle 105 which, in turn, causes the rotation (or flipping over) of paddle support 101. Adjustment of the effective length of wire 113 can be effected by turning a screw 117 mounted on bracket 63, which acts as a stop for a second end 119 of crankshaft 115. By adjusting the effective length of wire 113, the extent of rotation of paddle support 101 can similarly be adjusted. In this manner, one can align different points of paddle support 101 with needle 67, thereby enabling different paddle openings 19 to become aligned with needle 67.

Said paddle positioning means also includes a paddle retention clamp 121. Clamp 121, which is an L-shaped member, is coupled to paddle support 101 by a pair of springs (not shown). When paddle support 101 is positioned to receive a paddle 15 from plate 55, a pair of screws 123-1 and 123-2 come into contact with a clamping stop 125, causing clamp 121 to be moved by the springs slightly away from paddle support 101. In this manner, a paddle 15 can be inserted between clamp 121 and paddle support 101. By contrast, when paddle support 101 begins to pivoted away from plate 55 by pivot arm 103, screws 123-1 and 123-2 lose contact with stop 125 and clamp 121 is moved towards paddle support 101. In this manner, a paddle 15 may be securely retained between paddle support 101 and clamp 121 during movement of paddle support 101 towards needle 67.

Apparatus 41 also includes a cutting blade 129, which is used to facilitate the severing of connectors 23 connecting the foremost paddle 15 to the remainder of web 21 as the foremost paddle 15 is moved on paddle support 101 into alignment with needle 67. As seen best in FIG. 5, blade 129 is mounted on a block 131 which, in turn, is fixedly mounted on plate 55 in such a way as to position blade 129 a short distance off to the side and over plate 55 while in alignment with pins 89-5 through 89-12.

Figure 8:
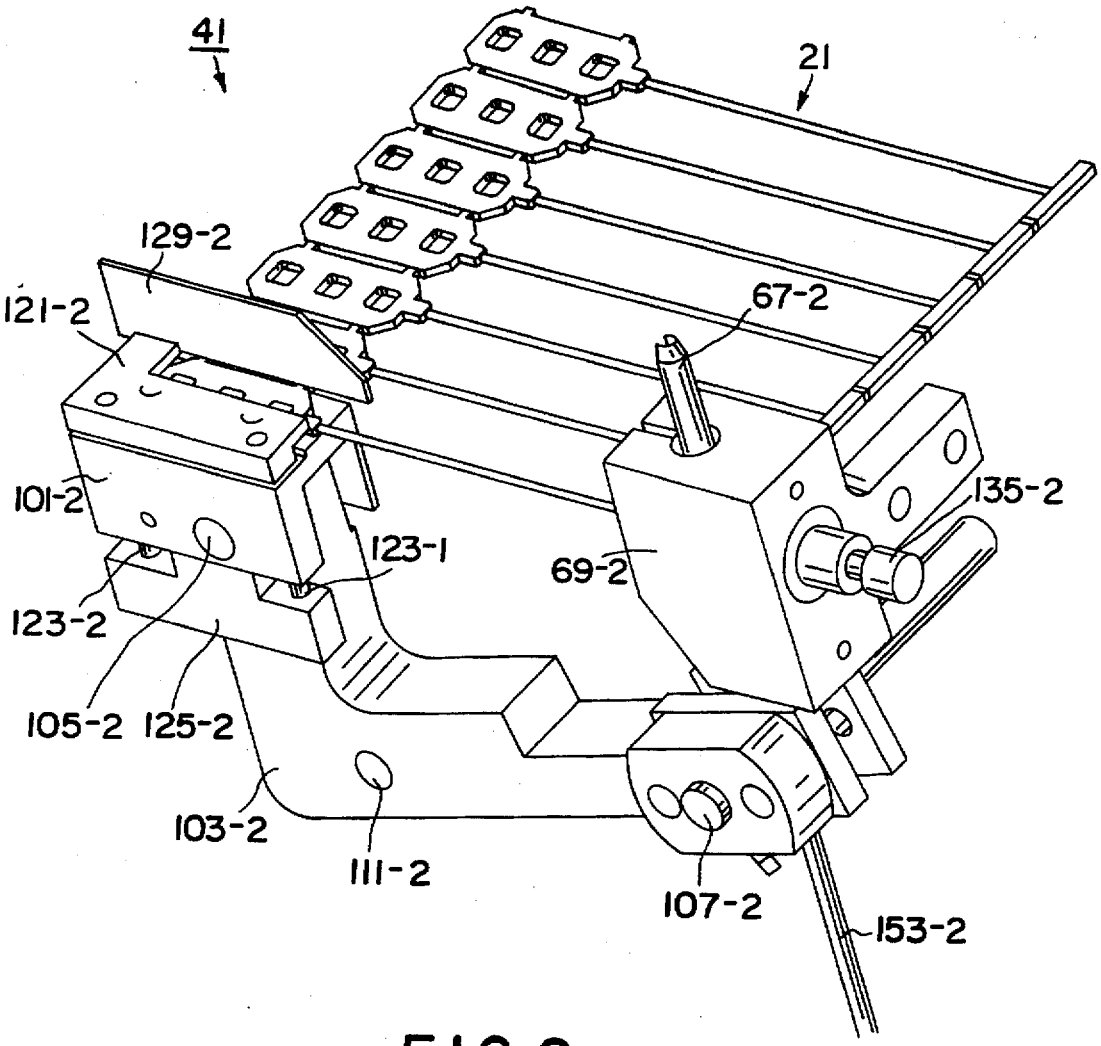
FIG. 8 is a simplified enlarged top view of the right portion of the apparatus shown in FIG. 4 illustrating certain aspects of the paddle positioning means, certain parts of the apparatus not being shown for clarity.
Figure 9:
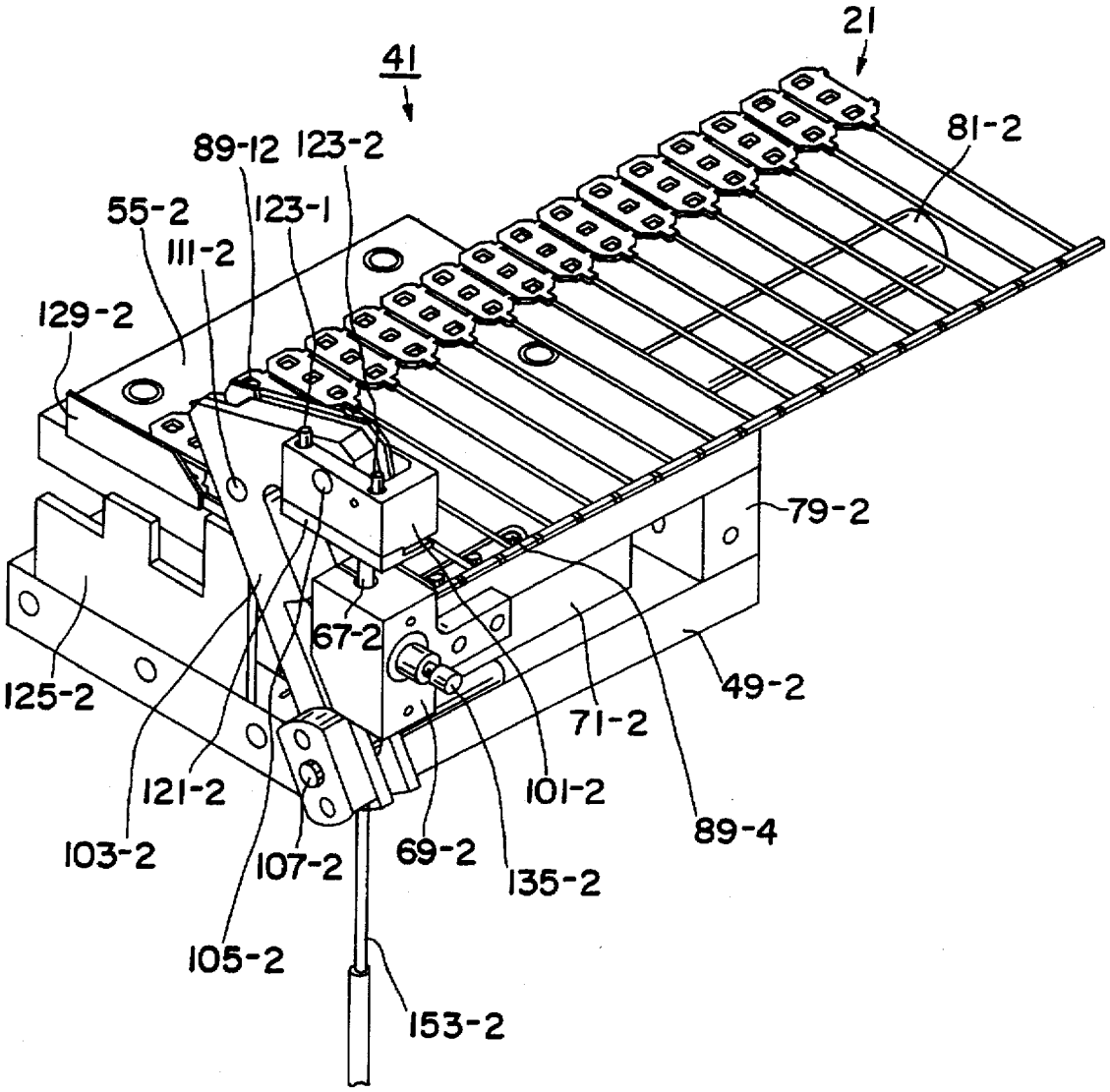
FIG. 9 is a simplified enlarged top view of the right portion of the apparatus shown in FIG. 4 illustrating certain aspects of the paddle positioning means, certain parts of the apparatus not being shown for clarity.

Referring now to FIGS. 5, 8 and 9, said cross-bar feeding means comprises a U-shaped, cross-bar receiving member 133 (see FIG. 5). Member 133, which is disposed within needle block 69 and which is accessible via an opening (not shown) in needle block 69, is aligned with the cross-bars 13 of web 21 on plate 55 and is adapted to receive the leading cross-bar 13 from web 21 at the same time that a corresponding paddle 15 is fed onto paddle support 101. Member 133 is mechanically coupled to a stationary (in terms of translational movement) pinion 135 which, in turn, rides along a movable rack 137. As rack 137 drives across pinion 135, member 133 rotates approximately 90 degrees. In this manner, severable connector 25 connecting cross-bar 13 to the remainder of web 21 is severed, and cross-bar 13 is brought into alignment with needle 67. Rack 137 is fixedly mounted on a vertically slidable block 141, the movement of which is driven by an air cylinder 151.

Said cross-bar ejecting means comprises an ejector rod 153. Ejector rod 153, like rack 137, is fixedly mounted on block 141 and is also moved up and down by virtue of air cylinder 151. As can be appreciated, once member 133 as been rotated 90 degrees, further upward movement of rack 137 is unnecessary and undesirable whereas further upward movement of ejector rod 153 is still needed to eject the cross-bar from needle 67. To accommodate these conflicting objectives, apparatus 41 additionally comprises the following arrangement: A post 155 is inserted into a spring 157. The bottom end of post 155 is mounted on block 141. A block 159 having an opening 160 through which post 155 may slide is mounted on the top end of spring 157. Rack 137 is mechanically coupled to block 141. A stop 161 having an opening 163 through which post 155 may also slide is spaced upwardly from block 159 at a distance corresponding to the amount of translational movement desired of rack 137. In this manner, because rack 137 is coupled to block 159, when block 159 hits up against stop 161, further upward movement of rack 137 is prevented. However, because post 155 is permitted to slide through openings 160 and 163, ejector rod 153 is permitted to continue its upward movement.

To use apparatus 41 to tie together two pairs of opposing shoelace eyelets of a shoe upper, an operator places a quantity of web 21 on each of web carrying plates 55-1 and 55-2 and positions pins 89-1 through 89-12 to engage web 21 in the manner described above. (The leading fastener 11 of each web 21, however, should be aligned at the outset with the corresponding paddle positioning means and the corresponding cross-bar feeding means.) The operator then inserts needles 67-1 and 67-2 through two pairs of opposing shoelace eyelets of a shoe upper. (If the two pair of shoelace eyelets require different spacings, which they likely will, screws 117-1 and 117-2 are adjusted accordingly to cause whatever rotation of paddle supports 105-1 and 105-2 is needed to properly align needles 67-1 and 67-2 with the desired openings 19-1, 19-2 or 19-3 of the two paddles 15.) The operator then actuates apparatus 41 by pressing a pedal (not shown) or by operating another similar control. This causes the simultaneous actuation of cylinders 109-1 and 109-2 and cylinders 151-1 and 151-2 which, as described above, results in each paddle 15 being aligned with its corresponding needle 67 and in each cross-bar 13 being fed into and ejected from its corresponding needle 67 through the corresponding pair of opposing eyelets of the shoe upper and then through the desired paddle opening 19. Cylinders 109 and 151 then return to their original state, causing the paddle positioning means, the cross-bar feeding means and the cross-bar ejecting means to return to their original positions. Cylinders 81 and 87 then become actuated, causing the advancement of the respective webs 21 in the manner described above. Once web advancement is complete, cylinders 81 and 87 return to their original state. The timing and sequence of actuation of the various air cylinders of apparatus 41 is controlled by suitable control means (not shown), such as electronic control means.

As can readily be appreciated, because apparatus 41 includes two sets of each of the necessary components to tie together a pair of opposing shoelace eyelets with fastener 11, either one could use both sets of components to simultaneously tie together two pairs of opposing eyelets (either of the same shoe upper or different shoe uppers) with a corresponding number of fasteners 11 or one could use just one set of components to tie together one set of opposing eyelets with one fastener 11.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. An apparatus for use in tying together a pair of opposing shoelace eyelets of a shoe upper with a plastic fastener of the type comprising a flexible filament having a cross-bar disposed at one end thereof and a paddle comprising an opening disposed at the opposite end thereof, said apparatus comprising:

(a) means for positioning the paddle of the plastic fastener so that the opening is aligned with the pair of opposing shoelace eyelets; and (b) means for inserting the cross-bar of the plastic fastener first through the pair of opposing eyelets and then through the opening in the paddle.

2. The apparatus as claimed in claim 1 wherein said cross-bar inserting means comprises a hollow slotted needle.

3. The apparatus as claimed in claim 2 further comprising means for feeding the cross-bar into said hollow slotted needle.

4. An apparatus for use in tying together a pair of opposing shoelace eyelets of a shoe upper with a plastic fastener of the type comprising a flexible filament having a cross-bar disposed at one end thereof and a paddle comprising an opening disposed at the opposite end thereof, said apparatus comprising:

(a) a hollow slotted needle insertable through the pair of opposing shoelace eyelets and the opening in the paddle;

(b) means for positioning the paddle of the plastic fastener so that the opening is aligned with said hollow slotted needle; and (c) means for dispensing the cross-bar of the plastic fastener through said hollow slotted needle.

5. The apparatus as claimed in claim 4 wherein the paddle of the plastic fastener comprises two alternate openings and wherein said paddle positioning means comprises means for adjustably positioning the paddle so that either one of said two alternate openings can be aligned with said hollow slotted needle.

6. An apparatus for use in tying together a pair of opposing shoelace eyelets of a shoe upper with a plastic fastener of the type comprising a flexible filament having a cross-bar disposed at one end thereof and a paddle comprising an opening disposed at the opposite end thereof, said apparatus comprising:

(a) a hollow slotted needle insertable through the pair of opposing shoelace eyelets and the opening in the paddle;

(b) a paddle positioning assembly for aligning the opening in the paddle with the hollow slotted needle;

(c) a cross-bar feeding assembly for loading the cross-bar into said hollow slotted needle; and (d) a cross-bar ejecting assembly for ejecting the cross-bar from said hollow slotted needle.

7. The apparatus as claimed in claim 6 wherein the plastic fastener is formed as part of a web of continuously connected fastener stock, said apparatus further comprising a web advancement assembly for advancing the web so that the paddle and the cross-bar of a plastic fastener are brought into register with the paddle positioning assembly and the cross-bar ejecting assembly, respectively.

8. The apparatus as claimed in claim 6 further comprising a cutting blade for use in severing the paddle of a plastic fastener brought into register with the paddle positioning assembly with an adjacent paddle of the remainder of the web of continuously connected fastener stock.

9. An apparatus for tying together each of two pairs of opposing shoelace eyelets of the same shoe upper with a plastic fastener of the type comprising a flexible filament having a cross-bar disposed at one end thereof and a paddle comprising an opening disposed at the opposite end thereof, said apparatus comprising:

(a) a first sub-unit comprising:

(i) a hollow slotted needle insertable through one of the two pair of opposing shoelace eyelets and the opening in the paddle of the first plastic fastener, (ii) a first paddle positioning assembly for aligning the opening in the paddle of the first plastic fastener with the first pair of opposing shoelace eyelets, (iii) a first cross-bar feeding assembly for loading the cross-bar of the first plastic fastener into said first hollow slotted needle, (iv) a first cross-bar ejecting assembly for ejecting the cross-bar of the first plastic fastener from said first hollow slotted needle, and (b) a second sub-unit comprising:

(i) a second hollow slotted needle insertable through the other of the two pair of opposing shoelace eyelets and the opening in the paddle of the second plastic fastener;

(ii) a second paddle positioning assembly for aligning the opening in the paddle of the second plastic fastener with the second pair of opposing shoelace eyelets;

(iii) a second cross-bar feeding assembly for loading the cross-bar of the second plastic fastener into said second hollow slotted needle;

(iv) a second cross-bar ejecting assembly for ejecting the cross-bar of the second plastic fastener from said second hollow slotted needle.

10. The apparatus as claimed in claim 9 wherein said first sub-unit and said second sub-unit are mirror images of one another.

11. The apparatus as claimed in claim 9 wherein the paddle of each of the first and the second plastic fastener comprises a first alternate opening and a second alternate opening and wherein each of said first and second paddle positioning means comprises means for adjustably positioning the paddle so that either one of said two alternate openings can be aligned with its corresponding hollow slotted needle.

12. The apparatus as claimed in claim 11 wherein said first paddle positioning means is configured to align the first alternate opening of a first fastener with said first hollow slotted needle and wherein said second paddle positioning means is configured to align the second alternate opening of a second fastener with the second hollow slotted needle.

13. The apparatus as claimed in claim 9 wherein said first and second slotted hollow needles are separated by a distance equal to that separating the two pairs of opposing eyelets.

* * * * *